US006857821B2

(12) United States Patent
Steenhuis et al.

(10) Patent No.: US 6,857,821 B2
(45) Date of Patent: Feb. 22, 2005

(54) DEVICE FOR LIFTING A SEAGOING CONSTRUCTION SUCH AS A DRILLING RIG, PROVIDED WITH LIFTING MEMBERS RUNNING MUTUALLY PARALLEL

(75) Inventors: André Luur Jan Steenhuis, Bērkel en Rodenrijs (NL); Martin Arie Schenkel, Maasland (NL)

(73) Assignee: Excalibur Engineerng B.V., Delft (NL)

( * ) Notice: Subject to any disclaimer, the term of this patent is extended or adjusted under 35 U.S.C. 154(b) by 0 days.

(21) Appl. No.: 10/239,715

(22) PCT Filed: Mar. 29, 2001

(86) PCT No.: PCT/NL01/00262

§ 371 (c)(1),
(2), (4) Date: Jan. 9, 2003

(87) PCT Pub. No.: WO01/72582

PCT Pub. Date: Oct. 4, 2001

(65) Prior Publication Data

US 2004/0037650 A1 Feb. 26, 2004

(51) Int. Cl.[7] ..... E02B 17/00

(52) U.S. Cl. ..... 405/203; 405/206; 405/209; 114/45; 114/50; 414/137.1

(58) Field of Search ..... 405/203–206, 405/209; 114/44, 45, 50, 365, 369, 373, 374; 414/137.1, 137.5, 137.9

(56) References Cited

U.S. PATENT DOCUMENTS 4,556,004 A * 12/1985 Lamy et al. ..... 414/137.5
4,690,087 A * 9/1987 Hadjis ..... 114/50
4,714,382 A * 12/1987 Khachaturian ..... 405/204
4,854,800 A * 8/1989 Frick et al. ..... 414/137.9
4,874,269 A * 10/1989 Dysarz ..... 405/209
5,483,912 A * 1/1996 Thomas ..... 114/259
5,829,919 A 11/1998 Heerema
6,171,028 B1 * 1/2001 Van Gelder ..... 405/209

FOREIGN PATENT DOCUMENTS

| | | | |
|---|---|---|---|
| FR | 2514317 | * | 4/1983 |
| FR | 2 514 317 A | | 4/1983 |
| GB | 2165188 | * | 4/1986 |
| GB | 2 165 188 A | | 4/1986 |
| GB | 2 199 791 A | | 7/1988 |
| GB | 2199791 | * | 7/1988 |
| GB | 2 306 407 A | | 5/1997 |
| GB | 2306407 | * | 5/1997 |
| JP | 61155509 | * | 7/1986 |

* cited by examiner

*Primary Examiner*—Jong-Suk (James) Lee
(74) *Attorney, Agent, or Firm*—Webb Ziesenheim Logsdon Orkin & Hanson, P.C.

(57) ABSTRACT

A device for lifting a seagoing construction such as a drilling rig, which device comprises one or more floater bodies, one or more beam-like lifting members supported movably on a floater body and running parallel or practically parallel to each other, wherein the or each lifting member is supported on at least two support points of the floater body, at least one of which is adjustable in height direction, and the end part of the lifting member lying outside the floater body has a pressure point which is in contact with the construction for lifting, this such that the seagoing construction can be easily connected to the end of the lifting member without this construction suffering damage as a result of the sea swell.

10 Claims, 5 Drawing Sheets

DEVICE FOR LIFTING A SEAGOING CONSTRUCTION SUCH AS A DRILLING RIG, PROVIDED WITH LIFTING MEMBERS RUNNING MUTUALLY PARALLEL

This application is a national stage of PCT/NL01/00262 filed Mar. 29, 2001 and based upon Netherlands 1014786 filed Mar. 29, 2000.

BACKGROUND OF THE INVENTION

1. Field of the Invention

The invention relates to a device for lifting a seagoing construction such as a drilling rig.

2. Description of the Related Art

Different methods for lifting such constructions at sea have already been proposed, such as described for instance in U.S. Pat. No. 5,829,919. Use is made herein of two floater bodies on either side of the construction for lifting, wherein lifting devices are arranged projecting along the longitudinal sides thereof. The drawback of such an embodiment is that the constituent components of the lifting means limit the free movement of the construction for lifting relative to the floater bodies. It is herein noted that the swell of the sea requires a continuous compensation of the relative movements of the floater bodies in relation to the construction to be lifted.

SUMMARY OF THE INVENTION

The invention has for its object to obviate the above stated drawback and to propose a lifting embodiment which enables an optimal freedom of movement of the construction for lifting relative to the floater bodies and which satisfies the requirement of movement compensation.

The device according to the invention is distinguished in that in the case of each lifting member at least one support point is adjustable in vertical and/or horizontal direction, at least the other support point allowing rotation of the beam-like lifting member in a horizontal or vertical plane, and the free end part of the lifting member has a pressure point coming into contact with the construction for to be lifted.

As a result of the beam-like lifting members according to the invention it is possible for the free end part projecting over the longitudinal side of the floater body to be embodied without space-requiring rods or cylinders, wherein the support point displaceable in vertical and horizontal direction for the beam-like lifting member is situated at a distance from the lifting point, this such that the lifting members can move vertically and horizontally independently of each other, thereby providing the optimal freedom of movement and movement compensation for the construction for lifting.

The invention further proposes to provide the said vertical and horizontal movable support point on the floater body with at least one cylinder, preferably a hydraulic cylinder, in order to control the vertical and horizontal displacement of the lifting member.

The other support point functions here more or less as pivot, wherein according to the invention this support point is preferably situated on the top side of the beam-like lifting member.

In another embodiment the one support point provided with two pendulum arms for suspending movably in all directions a lifting member or a pair of lifting members extending parallel adjacently of each other.

It is herein possible to embody the pendulum arms themselves as cylinders or to suspend the pendulum arms from a separate pivot arm which is supported by an associated cylinder.

DETAILED DESCRIPTION OF THE PREFERRED EMBODIMENTS

Figure 1:
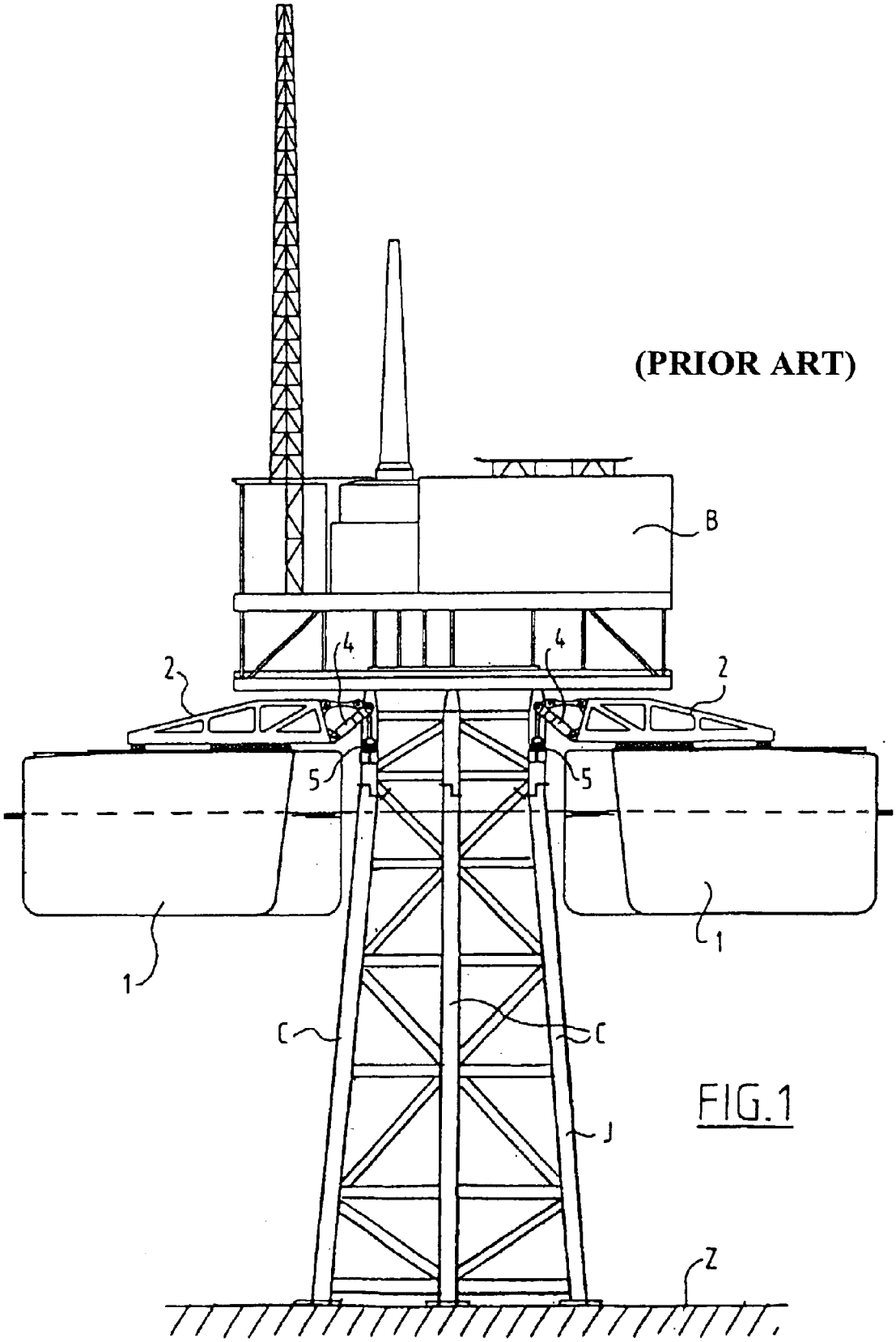
FIG. 1 is an upright side view of a seagoing construction, here a drilling rig, along which a prior art device for lifting the upper part of the construction is shown.

Referring to FIG. 1, this shows the prior art wherein the lifting device is arranged on either side of a drilling rig, which consists of a jacket J and a superstructure B placed thereon, which superstructure B must be lifted and then removed.

For this purpose a separation is arranged in the vertical posts C at the top side in the jacket once the superstructure B is supported by the prior art device. This consists of floater bodies 1 for placing on either side of the jacket, a carriage construction 2 which is arranged displaceably relative to floater bodies 1 and on the side of which directed toward the jacket is arranged a lifting device 4 provided with pendulum arms 5.

It will be apparent that this construction is in the structure of the jacket, whereby the relative freedom of movement of floater bodies 1, carriage construction 2 and the jacket is obstructed.

Figure 2:
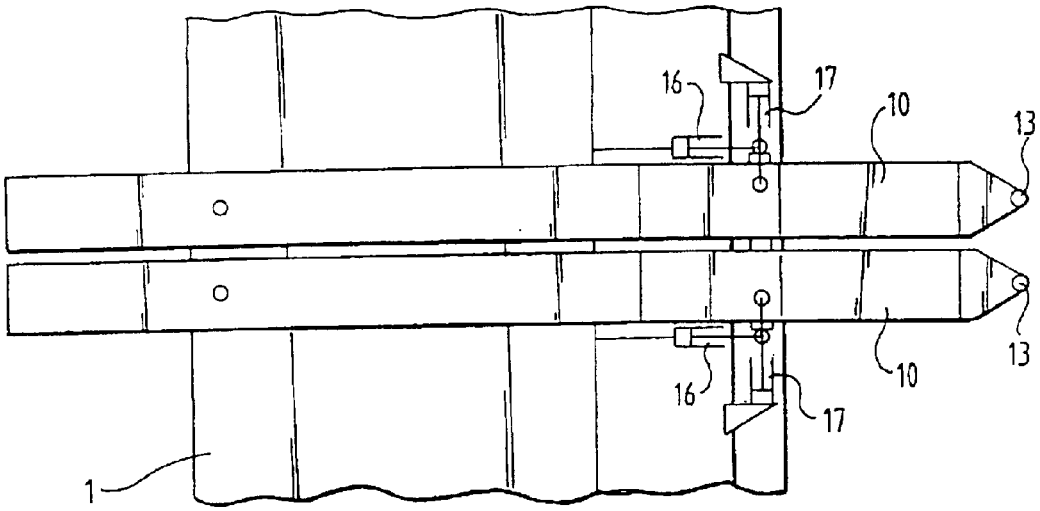
FIGS. 2 and 3 are respectively a top and side view of a first embodiment of the device according to the invention.
Figure 3:
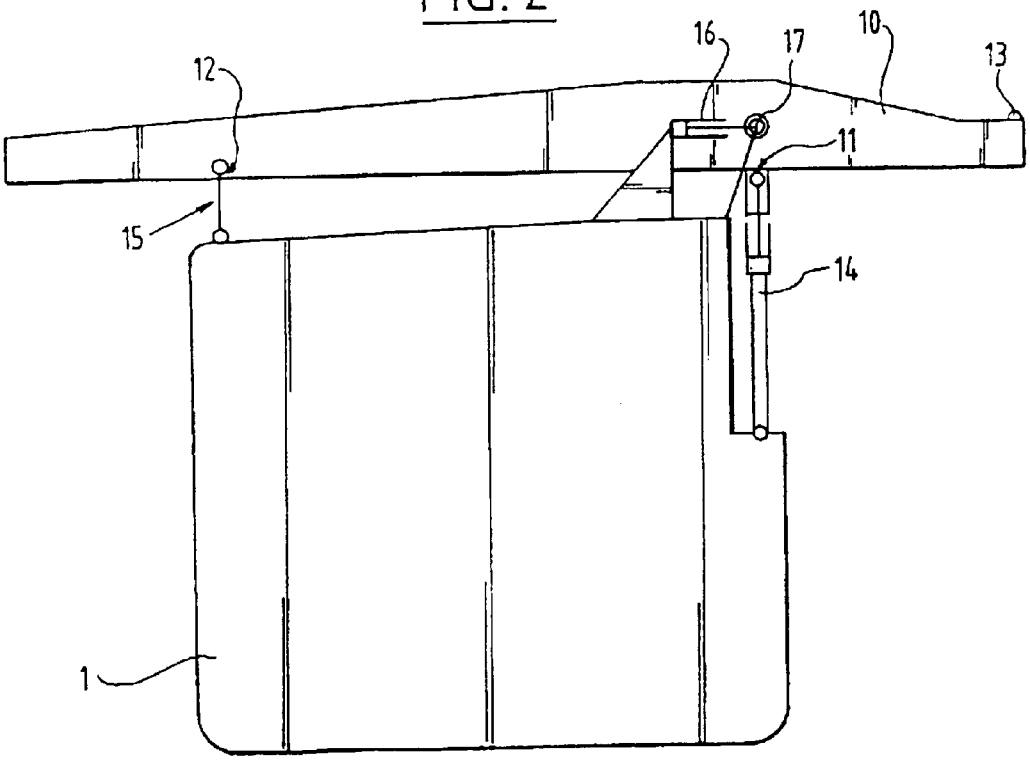

FIGS. 2 and 3 show an embodiment wherein a pair of beam-like lifting members 10 are arranged in mutually parallel direction on each of the floater bodies 1.

The number of pairs of beam-like lifting members 10 is for instance four per floater body, this number depending on the number of vertical posts C of the jacket.

Each beam-like lifting member 10 is supported by floater body 1 at the one support point 11 respectively the other support point 12. The end of each beam-like lifting member 10 projecting outside floater body 1 is provided with a pressure point 13 which is arranged under a cam N of a sleeve M arranged round the post C of the jacket, see FIG. 7.

In the embodiment of FIG. 2 and 3 the one support point is provided with a hydraulic cylinder 14 for the vertical movement of support point 11 in upward respectively downward direction. Said cylinder is arranged pivotably to said floating member 1 and beam-like member in order to allow horizontal displacement in a horizontal plane to said support point. The other support point 12 is provided with a pull rod 15 which is mounted pivotally on both the floater body 1 and the beam-like lifting member. A hydraulic cylinder 16 is arranged effecting or controlling a horizontal displacement of lifting member 10, while in top view a third cylinder 17 is placed to bring about or control the lateral freedom of movement of the lifting member. Pressure point 13 is thus movable in a three-way coordinate system, with respect to the floating member.

Because each beam-like lifting member 10 can be adjusted individually, a high degree of freedom of movement and co-displacement with the swell of the sea is possible.

Figure 4:
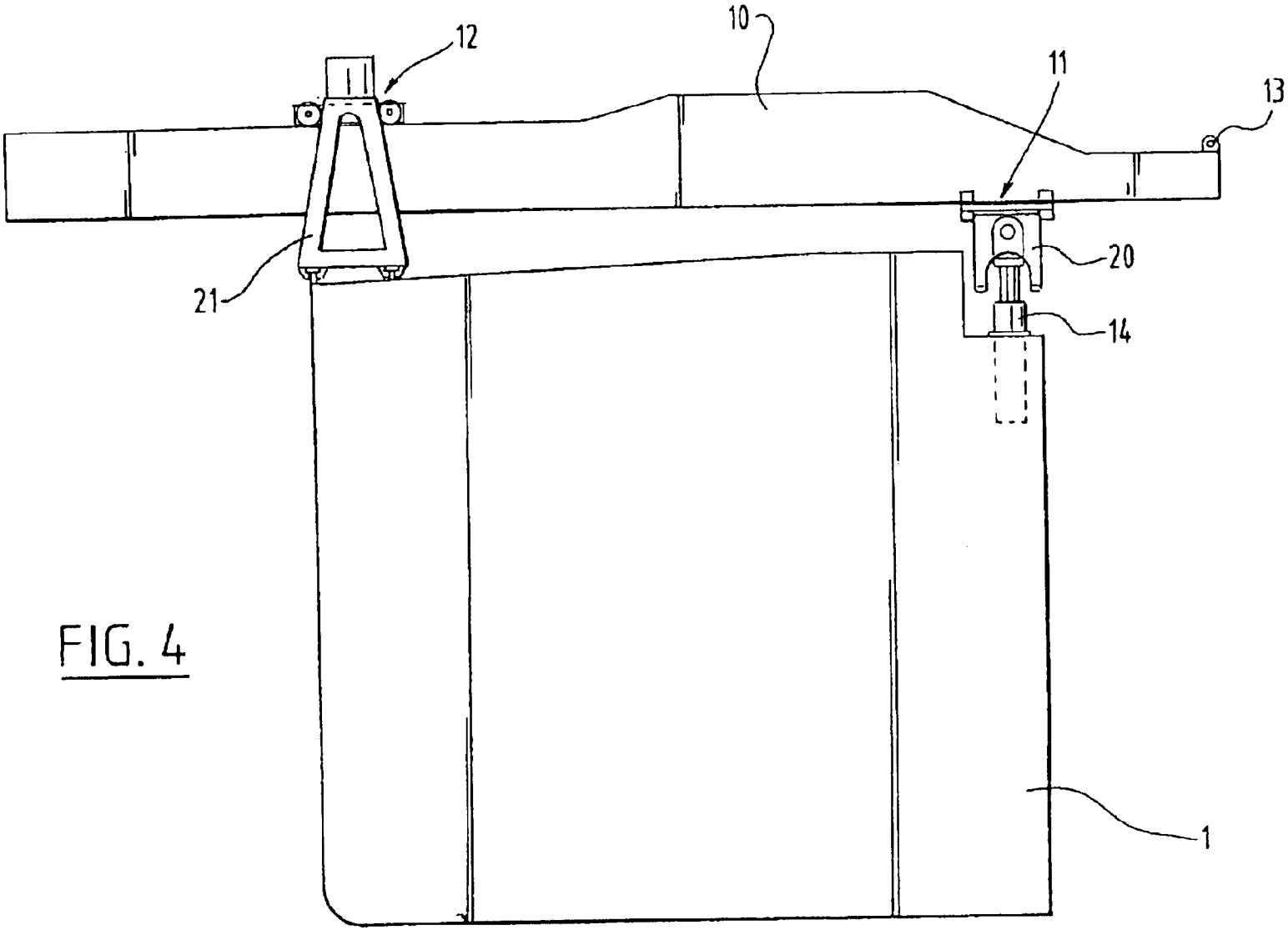
FIG. 4 is a side view corresponding with FIG. 1 of a second embodiment of the device according to the invention.

FIG. 4 shows an embodiment wherein the beam-like lifting member 10 is supported slidably at the one support point 11 on a cross beam 20 which is itself supported on more than one vertically operating cylinder 14 for the vertical adjustment thereof.

The other support point 12 is embodied with a trestle 21 against which the top side of beam-like lifting member 10 supports such that a longitudinal movement, a rotation in a vertical or horizontal plane of said lifting member 10 remains possible.

Figure 5:
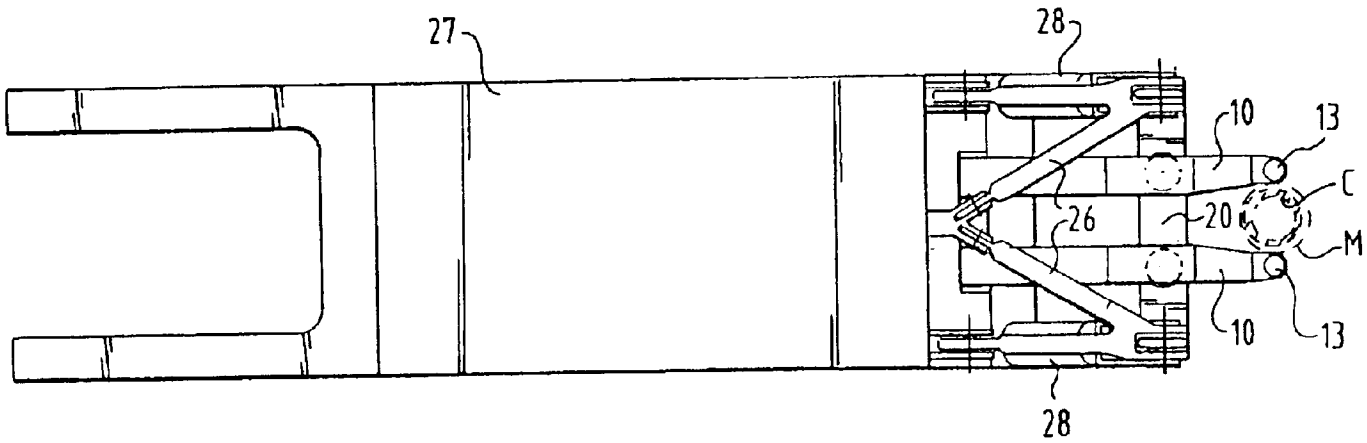
FIGS. 5 and 6 are respectively a top and an upright side view of a third embodiment according to the invention.
Figure 6:
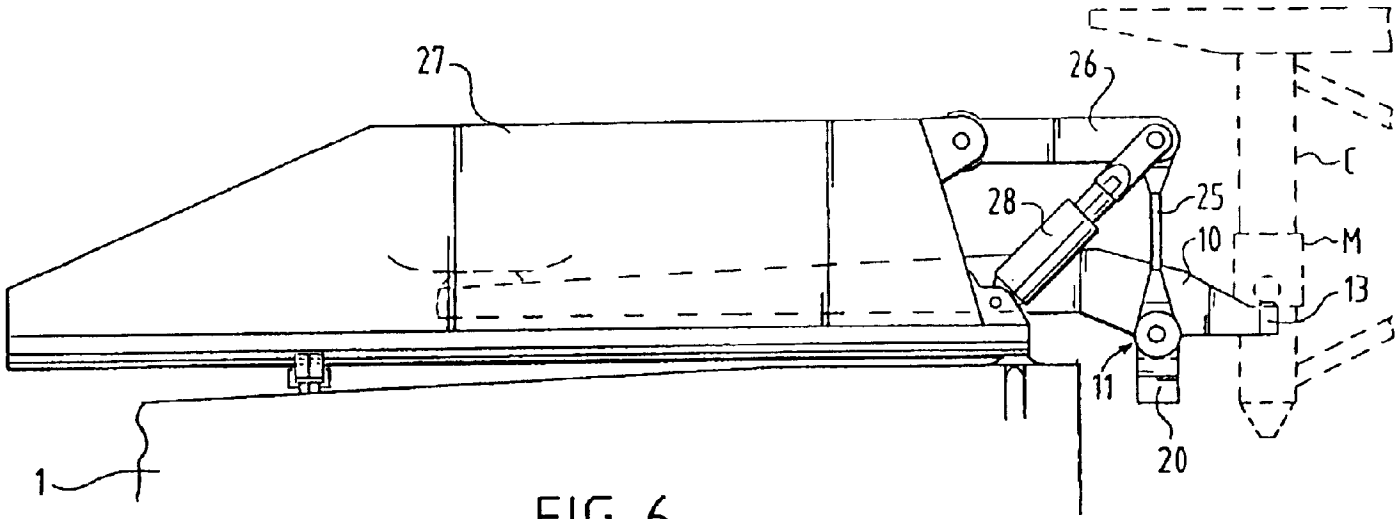
Figure 7:
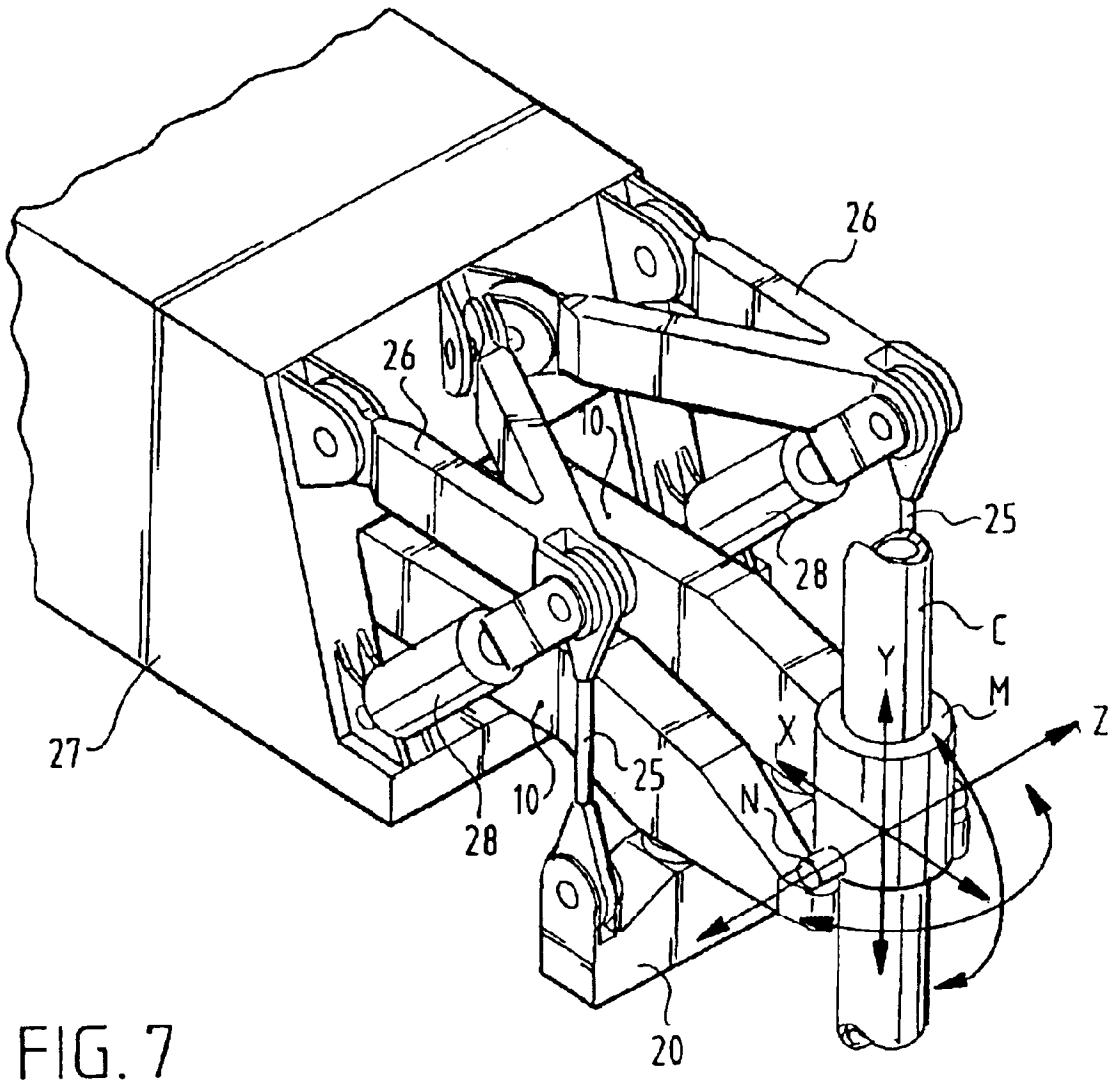
FIG. 7 is a perspective view of the lifting side of the device of FIG. 6.

In the embodiment of FIGS. 5 and 6 two beam-like lifting members 10 are supported in each case at the one support point 11 by a common horizontal beam 20 which is suspended from pendulum arms 25 such that they can pivot in all directions along the three spatial main axes X, Y and Z, see FIG. 7. Pendulum arms 25 are themselves suspended for pivoting in all directions on a pivot arm construction 26, wherein between the housing-like construction 27 arranged on floater body 1 and pendulum arms 25 there is placed a cylinder 28 to enable movement in vertical direction of pendulum arms 25, and thereby of beam-like lifting members 10. The other support point for beam-like lifting members 10 is arranged in the housing-like part 27 and can be realized in the manner as shown in FIG. 4 respectively FIG. 2.

It will be apparent from the foregoing that each of the pressure points 13 of lifting members 10 has a freedom of movement in all directions which are largely independent of each other. It is thereby possible to raise the superstructure of a drilling rig under very safe conditions, irrespective of the swell of the sea. The invention is not limited to the above described embodiment.

What is claimed is:

1. A device for lifting a seagoing construction, the device comprising at least one floater body located on either side of the seagoing construction, at least one beam-shaped lifting member supported movably on a floater body and running substantially parallel to each other and supported on at least two support points of the floater body, wherein at least one of the support points is adjustable in at least one of a vertical and a horizontal direction, at least the other of the support points allowing rotation of the beam-shaped lifting member in at least one of a horizontal and a vertical plane, and the free end part of the lifting member having a pressure point in contact with the construction to be lifted.

2. The device as claimed in claim 1, wherein the one support point of the floater body located nearer the construction for lifting is provided with at least one cylinder for vertical displacement of the lifting member.

3. The device as claimed in claim 2, wherein a plurality of lifting members of a floater body is supported by a common cross beam on which the at least one cylinder engages.

4. The device as claimed in claim 3, wherein at least the other support point allows a longitudinal displacement of the beam-shaped lifting member.

5. The device as claimed in claim 4, wherein the other support point is arranged on the top side of the beam-like lifting member.

6. The device as claimed in claim 2, wherein the one support point is provided with two pendulum arms for suspending movably in all directions the lifting member.

7. The device as claimed in claim 6, wherein at least one of the pendulum arms is suspended from a pivot arm, and the pivot arm is adjustable in the vertical plane by means of the cylinder.

8. The device as claimed in claim 2, herein the at least one cylinder is a hydraulic cylinder.

9. The device as claimed in claim 2, wherein the one support point is provided with two pendulum arms for suspending movably in all directions a pair of lifting members extending parallel adjacently of each other.

10. The device as claimed in claim 1, wherein the seagoing construction is a drilling rig.

* * * * *

UNITED STATES PATENT AND TRADEMARK OFFICE

CERTIFICATE OF CORRECTION

PATENT NO. : 6,857,821 B2
DATED : February 22, 2005
INVENTOR(S) : Steenhuis et al.

It is certified that error appears in the above-identified patent and that said Letters Patent is hereby corrected as shown below:

Title page,
Insert Item: -- [30] Foreign Application Priority Data
March 29, 2000 (NL) 1014786 --.

Column 1,
Line 37, delete "vertical and/or horizontal" and insert therefor:
-- vertical and horizontal --.
Line 41, delete "for to be lifted" and insert therefor:
-- to be lifted --.

Column 4,
Line 1, delete "on a floater body" and insert therefor:
-- on the at least one floater body --.

Signed and Sealed this

First Day of November, 2005

JON W. DUDAS
*Director of the United States Patent and Trademark Office*